US005800574A

United States Patent [19]

Ricci et al.

[11] Patent Number: 5,800,574

[45] Date of Patent: Sep. 1, 1998

[54] V-END SETTINGS AND METHOD OF MAKING SAME

[75] Inventors: Walter Ricci, Midlothian; Mark Fillman, Richmond; Michael Shields, Chesterfield; Eric Trevelian, Sandston; Steve Stickley, Midlothian, all of Va.

[73] Assignee: Hoover & Strong, Richmond, Va.

[21] Appl. No.: 779,905

[22] Filed: Jan. 7, 1997

[51] Int. Cl.[6] ..... B23P 5/00; A44C 17/02

[52] U.S. Cl. ..... 29/10; 29/896.41; 29/896.412; 29/897; 63/26

[58] Field of Search ..... 29/10, 896.41, 29/896.412, 897; 63/15, 26, 27, 28

[56] References Cited

U.S. PATENT DOCUMENTS

| | | | |
|---|---|---|---|
| D. 195,690 | 7/1963 | Gibeault . | |
| D. 196,135 | 8/1963 | Hazelquist . | |
| 157,332 | 12/1874 | Hubbard . | |
| 233,158 | 10/1880 | MacKinney | 63/27 |
| 532,587 | 1/1895 | Schill . | |
| 664,725 | 12/1900 | Costigan . | |
| 722,824 | 3/1903 | Dover | 63/27 |
| 1,035,310 | 8/1912 | Brevetti . | |
| 1,114,370 | 10/1914 | Ladd . | |
| 1,326,977 | 1/1920 | Schwartzman . | |
| 1,453,708 | 4/1923 | Gaschke . | |
| 1,585,516 | 4/1926 | Steller . | |
| 1,941,782 | 1/1934 | Bager . | |
| 2,035,244 | 3/1936 | Pejchar . | |
| 2,184,749 | 12/1939 | Manne et al. . | |
| 2,729,955 | 1/1956 | Jay . | |
| 2,763,140 | 9/1956 | Lutrario . | |
| 3,643,467 | 2/1972 | Pastel . | |
| 4,793,156 | 12/1988 | Pence . | |
| 5,671,613 | 9/1997 | Hoover et al. . | |

FOREIGN PATENT DOCUMENTS

| | | |
|---|---|---|
| 564287 | 10/1958 | Canada . |

*Primary Examiner*—P. W. Echols

*Attorney, Agent, or Firm*—Oliff & Berridge, PLC

[57] ABSTRACT

A setting and a method of making a setting include a V-end prong member having two V-shaped prongs preferably fabricated from a single length of material such as, for example, a round wire. Two grooves are die-struck into the length of material and extend from a center portion of the length of material toward opposite ends thereof. The length of material is blanked so as to trim excess material therefrom, forming a blank having opposite, receptacle-defining end portions, and a central portion. The blank is then bent so that the receptacles face each other to define the V-end prong member having two V-shaped end prongs and a central portion. A conventional prong member can then be attached to the central portion of the V-end prong member. The prong member includes spaced distal ends that confine the article between the spaced distal ends and the receptacles.

33 Claims, 8 Drawing Sheets

V-END SETTINGS AND METHOD OF MAKING SAME

BACKGROUND OF THE INVENTION

1. Field of the Invention

The invention relates to the field of article supports, and in particular to gem settings having end prongs that are V-shaped in cross section, also referred to as V-end settings, which are particularly useful for setting marquise, pear-shaped or princess cut gemstones.

2. Description of Related Art

Gem settings normally include a number of metal prongs or legs radiating from a base. After placing a gemstone in the setting, the jeweler bends ends of the prongs over to hold the gemstone captive without unduly concealing the gemstone's surface. A conventional method for forming settings for gemstones and the like involves stamping out a plurality of interfittable prong members from sheet metal. Each stamped prong member has two spaced prongs. The prong members are assembled by means of complementary notches therein and then are soldered together. The setting can then be assembled into jewelry as required, for example, by being attached to the shank of a ring, typically by soldering the attached prong members to a complementary gap in a ring shank. Settings formed from these assembled prong members are typically provided to jewelers who notch the prong members adjacent their distal ends, force a faceted gemstone or the like into the notches and bend the ends of the prongs over the gemstone to hold it in place in the setting. The setting then is polished to provide a suitable finish.

While the settings described above work well for stones that are cut to round or radially symmetrical polygonal shapes, they are not suitable for heart, princess cut, triangle, pear-shaped and particularly marquise stones. Typically, settings for such stones include a pair of V-shaped end prongs for engaging the longitudinal ends of the stone. Such settings also can be referred to as V-end settings.

Typically the V-shaped end prongs are formed by soldering V-shaped thin sheet extensions onto the stubs of a short stamped prong member. The thin sheet Vs are aligned to enclose the pointed ends of the marquise stone and are soldered to the stubs. FIGS. 15A–15D illustrate some of the steps involved in manufacturing such a V-end setting. FIG. 15A illustrates a stamped prong member 150 having two prongs. Three prong members are soldered together to form a setting 160 having six straight prongs as shown in FIG. 15B. The ends of two of the prongs (typically, these two prongs are located on the same prong member) are cut-off, forming stubs **162*a* and 162*b* as shown in FIG. 15C. Finally, V-shaped thin sheet extensions 164*a* and 164*b* are soldered onto the respective stubs 162*a* and 162*b*, as shown in FIG. 15D, to complete the V-end setting 180**.

V-end settings made by the above process are difficult to produce and have been found to lack the necessary strength. It is difficult to hold the V-shaped members in position when soldering the thin sheets to the stubs and when soldering the engaged prongs to one another. Accordingly, the cost and complexity of manufacturing settings of this type have been high, and the result is not always acceptable.

U.S. Pat. No. 4,793,156 to Pence discloses a setting including V-shaped end prongs in which the prong member having the V-shaped end prongs is made from a single length of sheet material. The length of sheet material is folded longitudinally to form a channel. The sides of the central portion of the channel are pressed tightly against each other to form a central web, while the sides of the channel at the ends are maintained spaced from each other to form two receptacles. The central portion is notched and then the folded sheet is bent in a direction perpendicular to a direction of folding so that the receptacles face toward one another. Conventional prong members are then soldered to the notch in the central web portion to form the setting.

SUMMARY OF THE INVENTION

Embodiments of the invention relate to a setting and a method of making a setting in which a V-end prong member having two V-shaped prongs is fabricated from a single length of material, such as, for example, a round wire. Two grooves are die-struck into the length of material and extend from a center portion of the length of material toward opposite ends thereof. The length of material is blanked so as to trim excess material therefrom. This forms a blank having opposite end portions and a central portion. Each of the opposite end portions includes one of the grooves, which define receptacles for holding the article. The blank is then bent so that the receptacles face each other to define the V-end prong member having two V-shaped end prongs and a central portion. A conventional prong member with precut seats can then be attached to the central portion of the V-end prong member. The prong member includes spaced distal ends that confine the article between the spaced distal ends and the receptacles.

Die-striking the grooves in the length of material is advantageous for at least two reasons. First, they form a reference structure in the material by which the material can be easily aligned in the tools used in subsequent steps. Second, the die-struck grooves enable sharp corners (which, it is believed are more attractive) to be more easily formed on the external edges of the V-ends. Typically, the grooves have a V-shaped cross-section.

V-end settings made by the disclosed process are advantageous in that the thickness of the material (e.g., the diameter of the wire) can be increased, which is usually recommended for larger karat stones, without increasing the width of the central portion of the V-end prong member. Prior art V-end prong members having folded, central web portions increase in width at the central web portion as the sheet material thickness increases, which can result in unattractive and unnecessarily bulky V-end settings.

Preferably, the blank is stamped to form stone point clearance features (e.g., holes) and seats in the receptacles, which are used by the jeweler to hold the ends of the gemstone. This eliminates the need for the jeweler to form seats in the V-ends, which can be difficult and time consuming.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

The drawings illustrate a progression of manufacturing steps according to an embodiment of the invention as well as the changing shape of the stock material proceeding through the steps, to manufacture a V-end setting for gemstones and the like. The invention produces settings having end prongs that are V-shaped in cross section and a strong central portion that can be attached to conventional stamped prong members that are provided with notches and that engage the gemstones along their sides. Settings are typically made of 10, 14 or 18 karat white or yellow gold, including palladium white and platinum alloys, 14 karat gold being preferred. In a preferred embodiment, the gold material is provided in the form of round wire, having a diameter in the range between 0.064 and 0.125 inches (1.6–3.2 millimeters). Of course, a setting for a larger stone normally uses a thicker material and vice-versa. Sheet material could be used instead of round wire.

The present invention is particularly useful for larger stones compared to the design disclosed in U.S. Pat. No. 4,793,156, for example, in that the thicker material can be used without effecting the width of the central portion of the V-end prong member because the central portion is not formed by tightly folding together opposite sides of sheet material. Accordingly, increasing the material thickness does not increase the width of the V-end prong member central portion, which would make the setting bulky and less attractive.

Figure 2A:
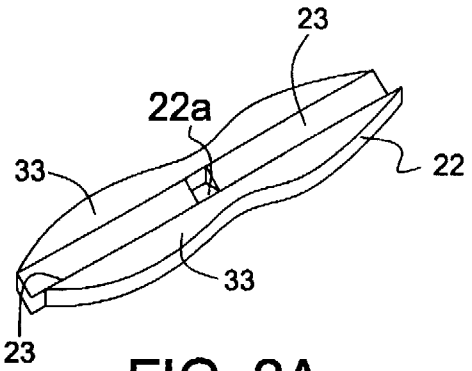
FIG. 2A is a perspective view of the top of the die-struck length of material.
Figure 2:
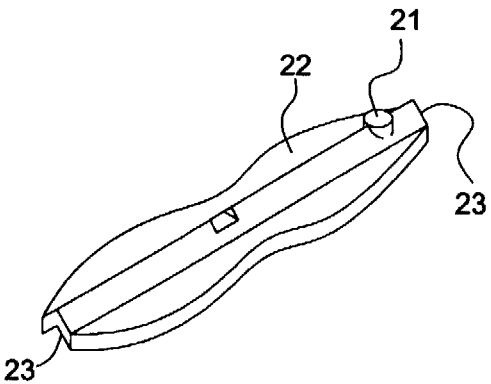
FIG. 2 is a perspective view of the bottom of the length of material after the grooves have been die-struck therein by the stamping tool.
Figure 1:
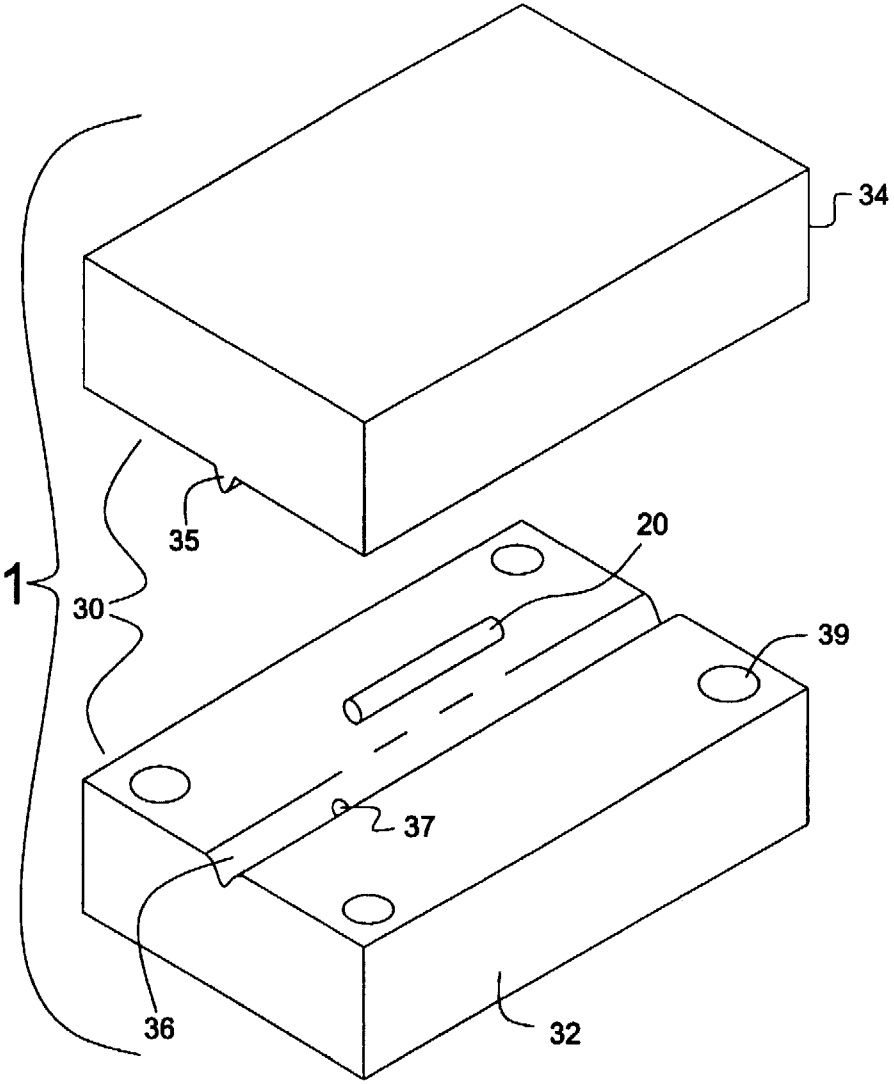
FIG. 1 is a perspective view of a stamping tool that is used to form V-shaped grooves in a length of round wire material according to an embodiment of the invention.

FIG. 1 is a perspective view of a stamping tool 30 that is used to form a seam in a length of material 20, which in the preferred embodiment is round wire. The resulting die-struck length of material 22 is shown in FIG. 2. A round shaped length of material (e.g., a wire) 20 is placed between a die 32 and a punch 34. The die 32 includes a longitudinal groove 36 therein, with a square protrusion (not shown) at a center thereof. In the preferred embodiment, the groove has a V-shaped cross section, although other shapes, for example shapes that are curved instead of pointed in cross section, may also be used. However, the V-shaped groove 36 results in a sharper edge being formed on the V-end prongs, which is more attractive than a curved profile. The punch 34 includes an elongated projection or tip 35 that mates with the groove 36 (i.e., it has a triangular cross section except at a central portion thereof, which has a more square cross-section). A small dimple 37 also preferably is formed on the die 32 and places an alignment mark 21 (see FIG. 2) in the die-struck length of material 22. The die 32 includes attachment members 39 that are precisely aligned with the groove 36 to attach the die to a support of the stamping machine. When the punch 34 engages the die 32, two grooves 23 having V-shaped cross sections are formed (i.e., die-struck) into the length of material 20. The grooves 23 extend longitudinally from a center portion 22*a* toward opposite end portions of the die-struck length of material 22.

The two grooves 23 could join each other at the center portion of the length of material, effectively resulting in a single groove extending the entire length. However, preferably the center portion 22*a* of the die-struck length of material 22 is formed to have a different cross-section than the grooves as shown in FIG. 2A, which is a top view of the die-struck length of material 22 of FIG. 2. In one embodiment, the center portion 22*a* is formed to have an indentation or groove having a substantially square cross-section. The depth of the center portion indentation can be more, less or the same as the groove depth. In any event, after the die-striking step, the resulting length of material has a shelf 33, the grooves 23 and the center portion 22*a*. Preferably, the material forming the V grooves has a thickness of 0.015–0.035 inches; the depth of the grooves (measured from the top of the shelf 33) is 0.010–0.040 inches; and the depth of the indentation at the center portion 22*a* (also measured from the top of the shelf 33) is 0.005–0.045 inches. The thickness of the material and the depths of the grooves 23 and center portion 22*a* indentation depends on the size of the gemstone being mounted. For example, a thickness of 0.020 inches, a groove depth of 0.017 inches and a center portion depth of 0.014 inches is preferred for settings for ¼ karat gemstones. The grooves need not extend through the center portion of the die-struck length of material 22, but only needs to extend from the opposite ends toward the center portion since the center portion ultimately will not be folded to form a channel.

Figure 4A:
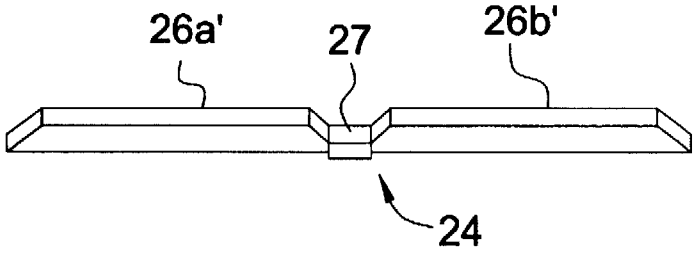
FIG. 4A is a side view of the FIG. 4 blank.
Figure 4:
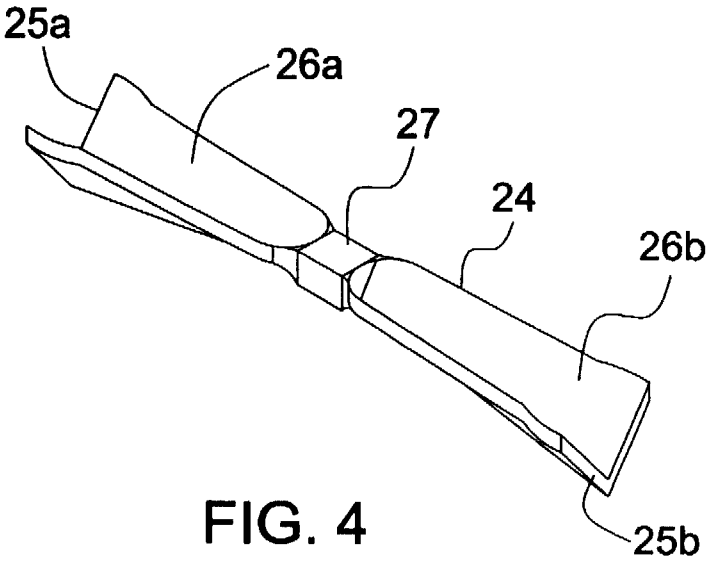
FIG. 4 is a perspective top view of the blank including its receptacles.
Figure 3A:
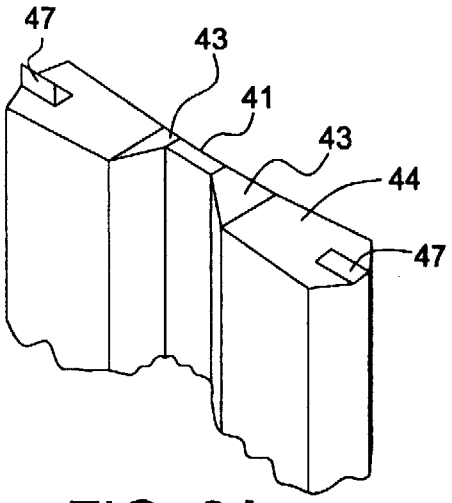
FIG. 3A is an enlarged perspective view of the punch used in the FIG. 3 blanking tool.

Next, as shown in FIGS. 3, 3A, 4 and 4A, the diestruck length of material is blanked by a blanking tool 40, which trims excess material (i.e., the shelf 33) to form a blank 24. The blanking tool 40 includes a die 42 and a punch 44. The punch 44 has a cross sectional shape that is complementary to an opening 48 formed in the die 42. The die 42 includes a groove 46 and a small hole 45 that receive the bottom surface of the grooves 23 and the dimple 21, respectively, so that the die-struck length of material 22 is precisely aligned and held in place on the die 42 during the stamping process. As can be seen in FIG. 3A, which is an enlarged view of the punch 44, the punch 44 includes a raised central portion 41 having sloped sidewalls 43 and protrusions 47 at each end. The protrusions 47 prevent the grooves 23 from collapsing or closing up when the punch 44 pushes the length of material 22 through the opening 48 in the die 22. Accordingly, the resulting blank 24 includes two receptacles 26*a* and 26*b* defined by the grooves 23. The raised central portion 41 and its inclined sidewalls 43 further indent the center portion of the length of material 22 so that the resulting blank 24 has a central portion 27 as illustrated in FIGS. 4A. In particular, the central portion 27 of the blank 24 is recessed relative to the edges 26*a*' and 26*b*' of the receptacles 26*a* and 26*b*, and also is flatter than the receptacles. Preferably, the ends 25*a* and 25*b* of the blank receptacles 26*a* and 26*b* are tapered slightly for aesthetic purposes. However, these ends could remain square or could be formed to have other shapes without departing from the spirit of the invention.

Figure 3:
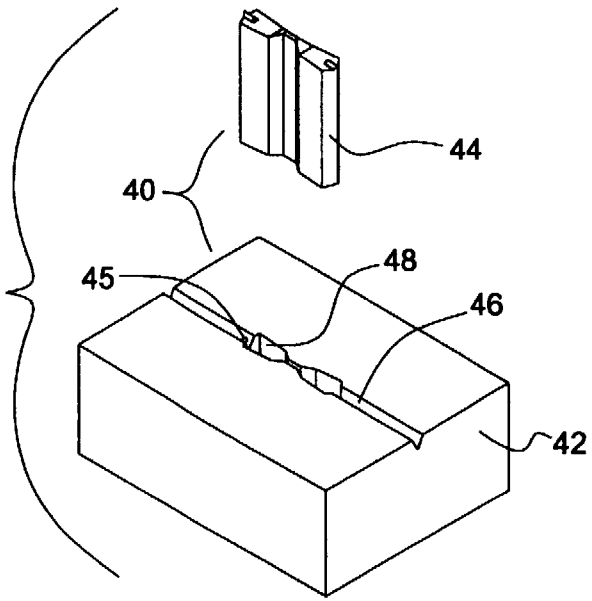
FIG. 3 is a perspective view of a blanking tool that trims excess material from the die-struck length of material, forming a blank having two receptacles therein.

While it is possible to perform the blanking step of FIG. 3 prior to the die-striking step of FIG. 1, it is preferable to perform the die-striking step first because the grooves 23 help to easily align the length of material in the blanking tool die 42.

Figure 6:
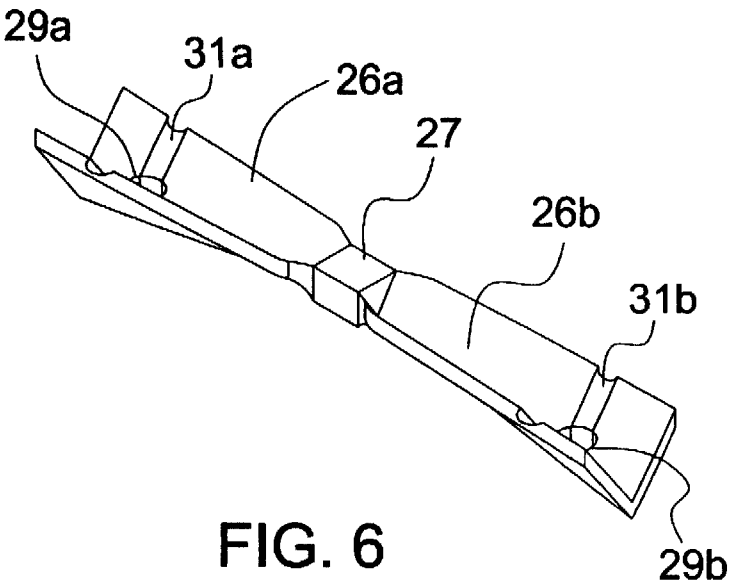
FIG. 6 is a perspective view of the blank including its seats and clearance holes.
Figure 5:
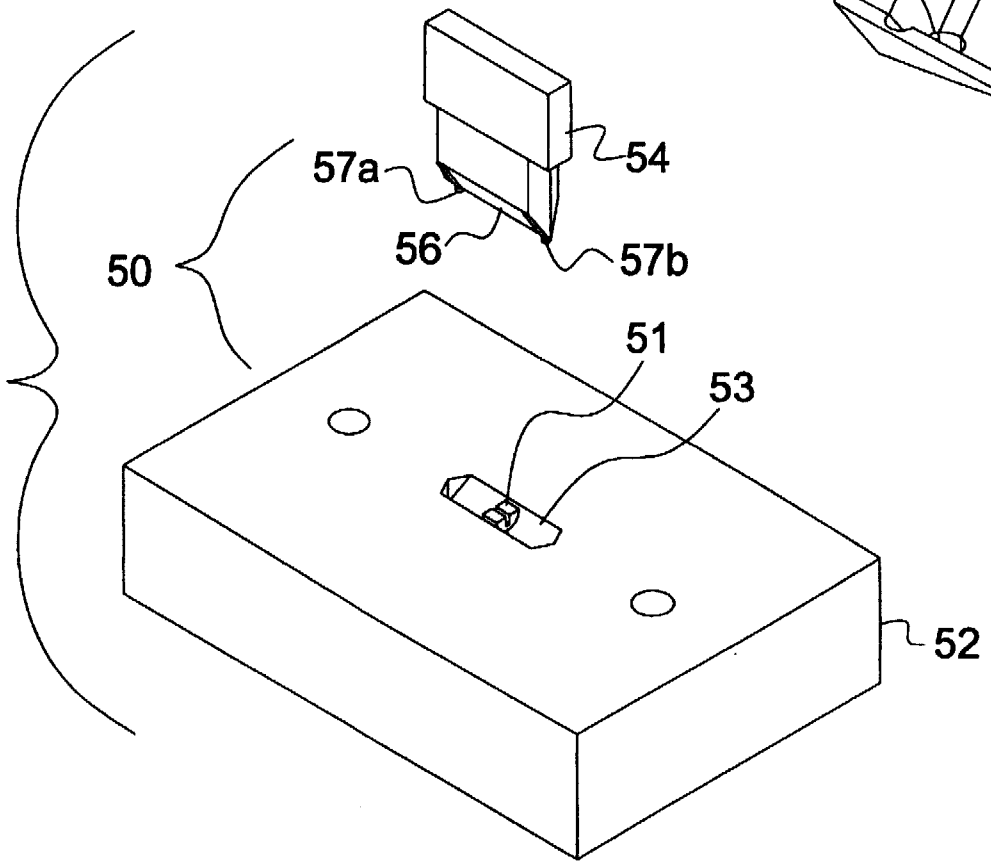
FIG. 5 is a perspective view of a forming tool according to an embodiment of the invention, which is used to form seats and, optionally stone point clearance holes, in the receptacles.

The blank 24 next could be bent, as will be described below in connection with FIGS. 7 and 8 so that the receptacles face each other. However, prior to bending it is preferable to form seats and clearance features in each receptacle so that the final product is easier for the jeweler to use. FIGS. 5 and 6 illustrate a forming tool that forms seats 31*a* and 31*b* and clearance features (in this embodiment holes) 29*a* and 29*b* in the receptacles 26*a* and 26*b* of the blank 24. As shown in FIG. 5, the forming tool 50 includes a die 52 and a punch 54. The die 52 includes a V-shaped groove 53 and a movable central holding member 51. The holding member 51 includes a central groove that receives and holds the central portion 27 of the blank 24. Holding member 51 is spring biased upwardly, but is pressed down into the groove 53 of the die 52 when the punch 54 is pressed into contact therewith. Punch 54 includes a tip 56 that is V-shaped in cross section to correspond with the V-shaped cross section of the groove 53. Additionally, protrusions 57*a* and 57*b* are provided near the ends of the tip 56. When the punch 54 is pressed against the blank, the blank is pressed into the groove 53 so as to maintain the form of the receptacles 26*a* and 26*b*, while the protrusions 57*a* and 57*b* are pressed into the receptacles to form stone point clearance holes 29*a* and 29*b* (see FIG. 6) near the ends of the receptacles 26*a* and 26*b*. Seats 31*a* and 31*b* can also be formed in the ends of each receptacle 26*a*, 26*b* by appropriately shaping the ends of the punch tip 56. The seats 31*a* and 31*b* assist the jeweler in bending the ends of the V-ends over the gemstone when it is set.

The stone point clearance holes 29*a* and 29*b* assist in holding the gemstone in place while it is being set, and also protect the pointed ends of the gemstone from being broken when the ends of the prongs are bent over the gemstone. Forming the stone point clearance holes 29*a* and 29*b* and the seats 31*a* and 31*b* provides a significant advantage in that the jeweler no longer has to take the time to form a seat in the V-end prongs, and this makes it easier for the jeweler to bend the ends of the V-end portions over the gemstone. Traditionally, the jeweler would drill or cut seats into the end prongs, which is time consuming and also is prone to accidentally cutting entirely through the end-prongs, which may not be desirable. With the preferred embodiments of the present invention, the depth of the seats can be precisely controlled at the point of manufacture. The clearance features need not be holes that extend entirely through the material, but could be indentations, for example.

The stone point clearance features and seats could, as an alternative, be formed during the die-striking step of FIG. 1, i.e., during formation of the grooves 23. However, it is preferable to form the seats and the clearance features during the FIG. 5 forming process because the groove die-striking step requires that the punch 34 exert a much higher force than the punch 54 of the forming step. Accordingly, the tip 35 of punch 34 requires occasional dressing (e.g., by form grinding), which would cause the protrusions used to form the clearance features and seats to be removed from the punch tip 35.

Figure 8:
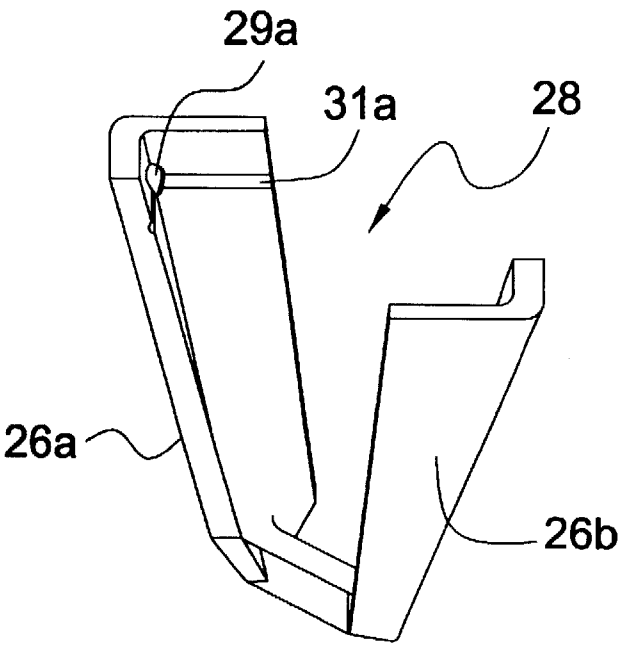
FIG. 8 is a perspective view of a finished V-end prong.
Figure 7:
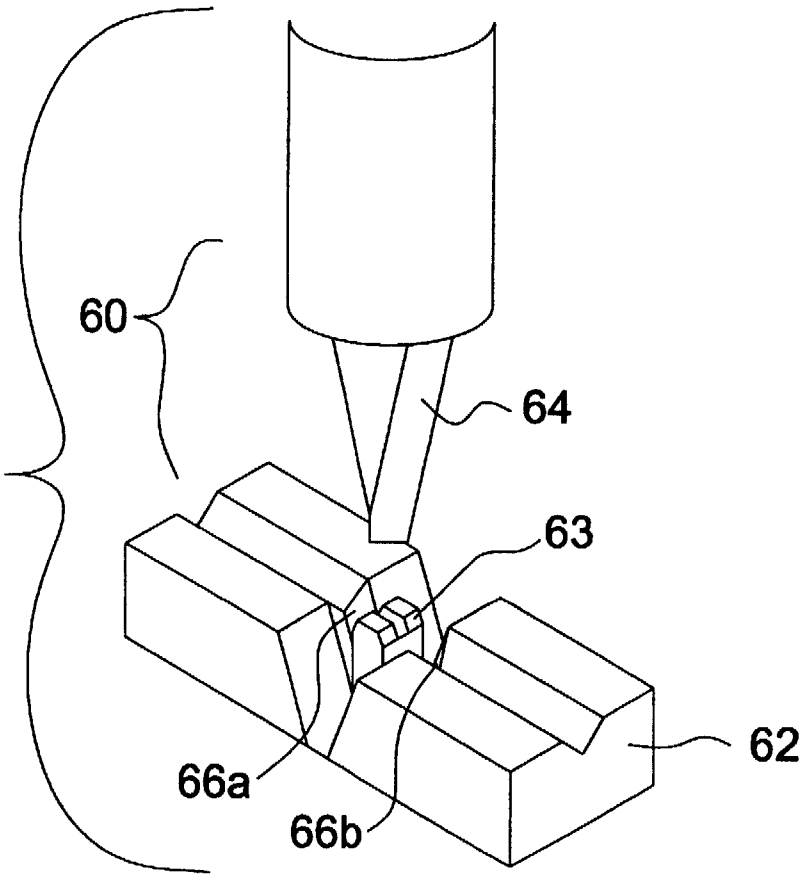
FIG. 7 is a perspective view of a V-end bending tool used to bend the blank into the finished V-end prong member.

FIGS. 7 and 8 show a bending tool and the resulting V-end prong member formed by the bending tool. As shown in FIG. 7, bending tool 60 includes a die 62 and a pressing member 64. Die 62 includes two inclined surfaces 66*a* and 66*b* and a holding member 63 that, like the holding member 51, includes a groove for engaging and holding central portion 27 and that also is spring biased upwardly. After the blank of FIG. 6 is placed in holding member 63, pressing member 64 engages the blank and presses the holding member 63 downwardly. This results in the receptacles 26*a* and 26*b* being bent upwardly. The resulting V-end prong member 28 is shown in FIG. 8.

Figure 10:
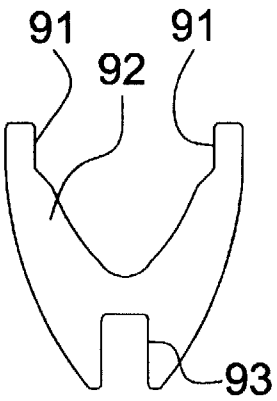
FIGS. 10 and 11 are prong members made by the FIG. 9 tool.
Figure 11:
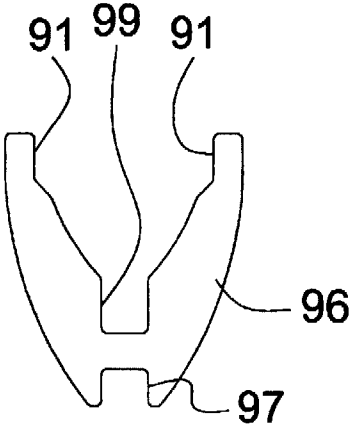
Figure 9:
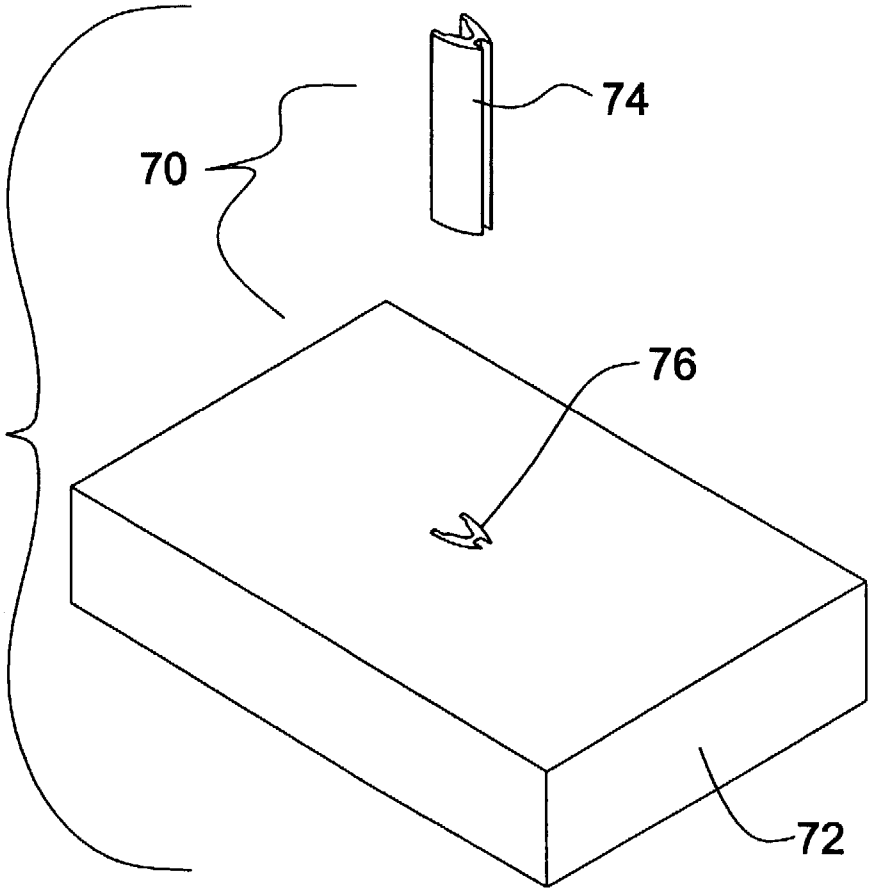
FIG. 9 is a perspective view of a blanking tool used to form conventional prong members with pre-cut seats.

FIGS. 9–11 illustrate a blanking tool for forming the conventional prong members and the prong members formed thereby. The blanking tool 70 includes a die 72 having an opening 76 and a complementary shaped punch 74. A piece of sheet material is placed on the die 72 over the opening 76 and the prong members 92 and 96 are formed in the conventional manner. As shown in FIG. 10, prong member 92 includes a large lower notch 93 and two distal ends 91 that form prongs with pre-cut seats for engaging the sides of the gem. FIG. 11 shows another prong member having a small lower notch 97 and an upper notch 99 that is placed in the notch 93 of prong member 92. Prong member 96 also includes distal ends 91 with pre-cut seats for engaging sides of the gem.

Figure 13:
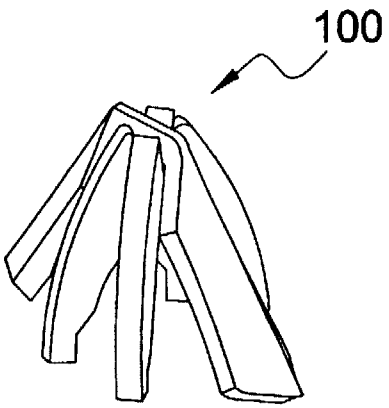
FIG. 13 is a perspective bottom view of an assembled V-end setting.
Figure 12:
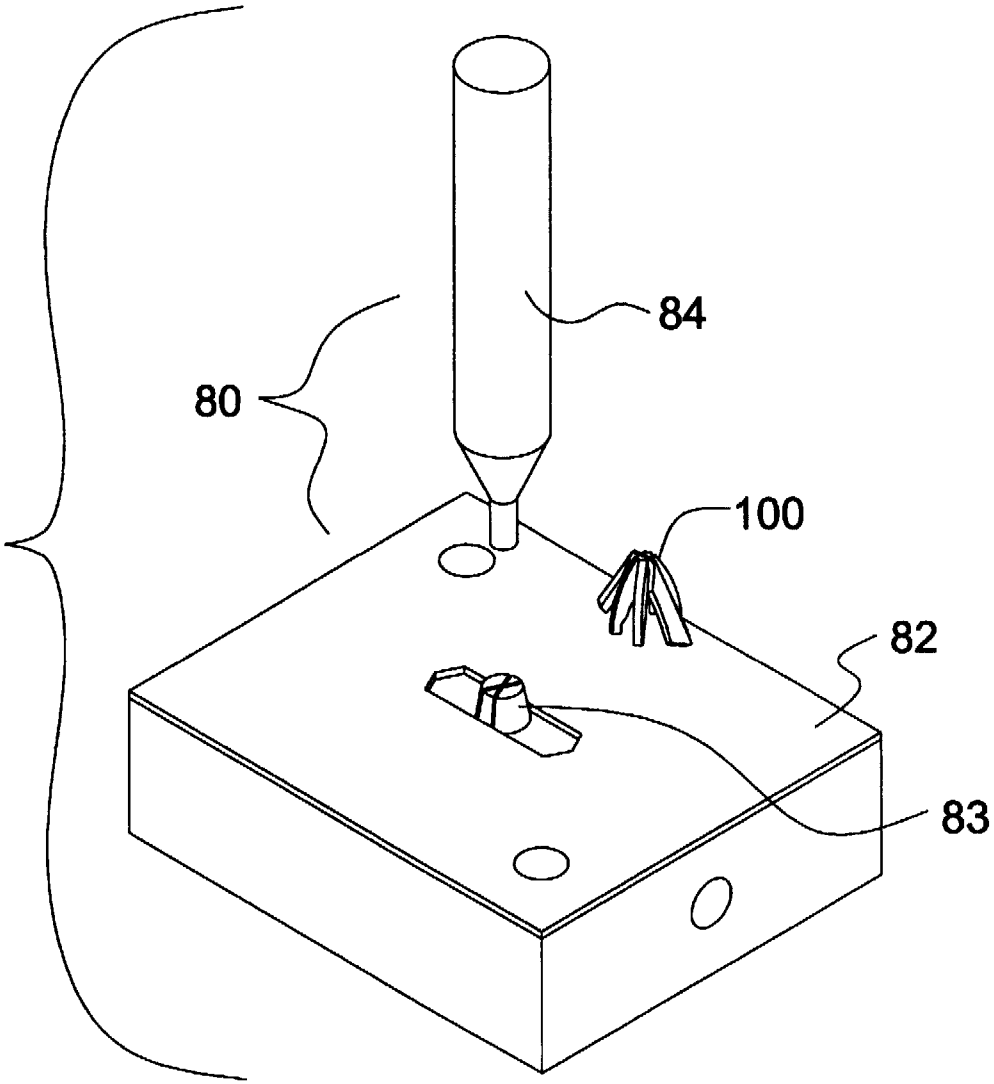
FIG. 12 is a perspective view of an assembly tool for assembling the V-end prong member and the prong members into a setting.
Figure 14:
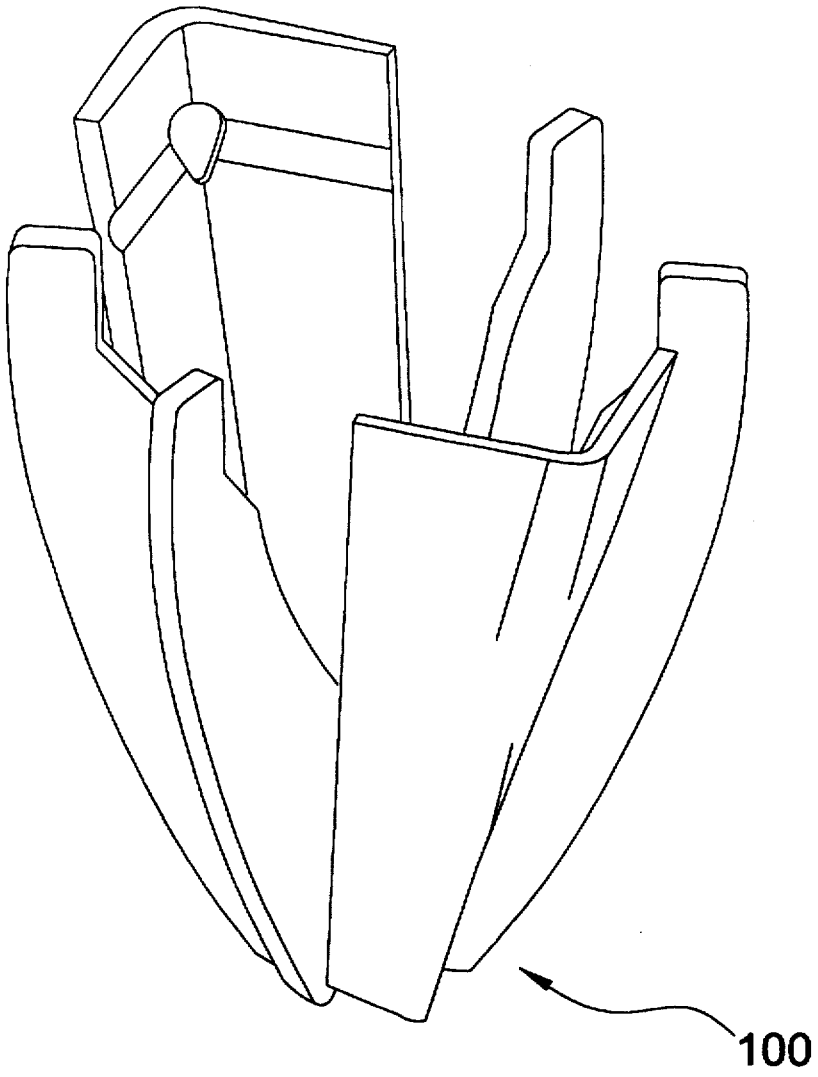
FIG. 14 is a top perspective view of the finished V-end setting.
Figure 15A:
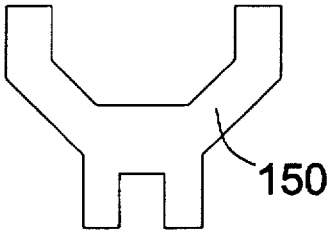
FIG. 15A (PRIOR ART)
FIGS. 15A–15D illustrate some of the steps involved in manufacturing a conventional V-end setting having V-ends that are soldered onto stubs from conventional prong members.
Figure 15B:
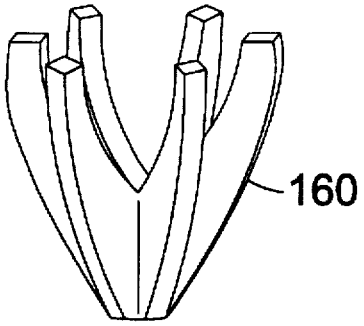
FIG. 15B (PRIOR ART)
Figure 15C:
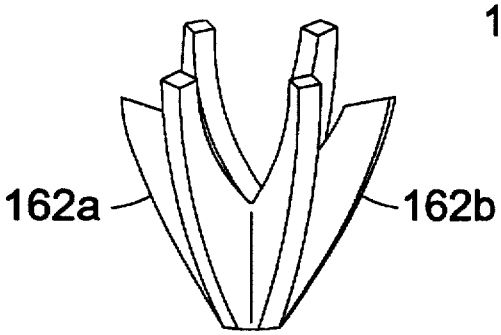
FIG. 15C (PRIOR ART)
Figure 15D:
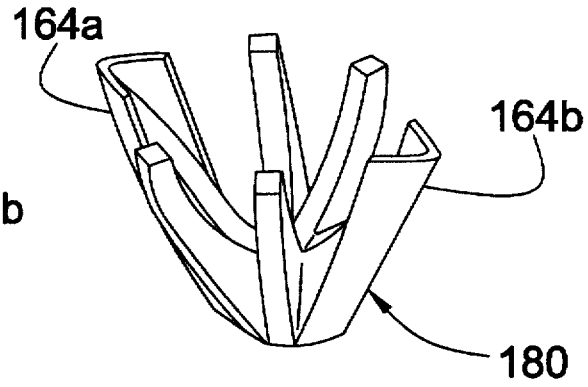
FIG. 15D (PRIOR ART)

FIG. 12 illustrates a setting assembly tool 80 having a support 82 with a supporting fixture 83 thereon. A tool 84 is used to place each of the prong members 92 and 96, as well as the V-end prong member 28 in place to form the setting 100. FIG. 13 is an enlarged perspective view of the assembled setting 100. As is well known in the art, the setting stays together temporarily because of the fit and tension between the prong members. Solder is applied to the setting and the setting is passed through a furnace where the prongs fuse together. The setting is then complete. FIG. 14 is a perspective top view of the completed V-end setting.

As mentioned above, V-end settings made in accordance with preferred embodiments of the invention are strong and inexpensive to manufacture, while providing the jeweler with a product that is easy to use and saves time.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A method of forming a setting for mounting an article, comprising:

die-striking a length of material to form two grooves in the length of material, each groove extending from a center portion of the length of material toward opposite ends of the length of material;

blanking the length of material so as to trim excess material therefrom, thereby forming a blank having opposite end portions and a central portion, each of the opposite end portions including one of the two grooves, which define receptacles for holding the article;

bending the blank so that the receptacles face each other, thereby defining a V-end prong member having two V-shaped prongs and a central portion; and attaching at least one prong member to the central portion of the V-end prong member, the prong member having spaced distal ends for confining the article between the spaced distal ends and the receptacles.

2. The method of claim 1, wherein the length of material is wire that is substantially round in shape.

3. The method of claim 1, wherein the two grooves are V-shaped in cross section.

4. The method of claim 1, wherein the two grooves meet at the center portion of the length of material.

5. The method of claim 4, wherein the two grooves have a substantially constant depth and the center portion of the length of material includes an indentation having a depth different from the depth of the two grooves.

6. The method of claim 1, wherein the center portion of the length of material includes an indentation that joins the two grooves, the indentation being flat relative to the two grooves.

7. The method of claim 1, wherein the blanking step is performed after the die-striking step, and the blanking step reforms the center portion of the length of material such that the central portion of the blank is recessed relative to edges of the receptacles.

8. The method of claim 1, further comprising, after the blanking step, forming a seat in at least one of the receptacles of the blank, the seat being provided to engage an end of the article that is to be mounted in the setting.

9. The method of claim 8, wherein one of the seats is formed in each of the receptacles of the blank, each of the seats being provided to engage a respective end of the article that is to be mounted in the setting.

10. The method of claim 8, further comprising forming a clearance in the seat during formation of the seat.

11. The method of claim 8, wherein the seat is formed by striking the blank with a tool.

12. The method of claim 1, wherein the prong member includes a notch, the prong member being attached to the V-end prong member by placing the central portion of the V-end prong member in the notch and soldering the central portion to the prong member in the vicinity of the notch.

13. A method of forming a setting for mounting an article, comprising:

die-striking a length of wire to form two grooves in the length of wire, each groove extending from end portions of the length of wire toward a center portion of the length of wire;

after the die-striking step, blanking the length of wire so as to trim excess material therefrom, thereby forming a blank having opposite end portions and a central portion, each of the opposite end portions including one of the two grooves, which define receptacles for holding the article;

forming a seat in each of the receptacles by striking the blank with a tool, each of the seats facilitating bending of ends of the receptacles over the article during setting of the article;

bending the blank so that the receptacles face each other, thereby defining a V-end prong member having two V-shaped prongs and a central portion; and attaching at least one prong member to the central portion of the V-end prong member, the prong member having spaced distal ends for confining the article between the spaced distal ends and the receptacles.

14. A method of forming a setting for mounting an article, comprising:

forming a V-end prong member having two receptacles that face each others each receptacle having a substantially V-shaped cross-section that includes two faces and a longitudinal groove joining the two faces;

forming a transverse indentation in a surface of at least one of the receptacles near an end portion of the at least one of the receptacles, the transverse indentation intersecting the longitudinal groove; and attaching at least one prong member to a central portion of the V-end prong member, the central portion connecting the two receptacles to each other, the prong member having two spaced distal ends for confining the article between the spaced distal ends and the two receptacles.

15. The method of claim 14, wherein the indentation forming step includes forming an indentation in surfaces in each of the two receptacles of the V-end prong member.

16. The method of claim 15, wherein the indentations are formed before the two receptacles are caused to face each other.

17. The method of claim 15, wherein the indentations are seats that extend across the receptacles near the end portions of the receptacles.

18. The method of claim 15, wherein the indentations do not extend entirely across the receptacles.

19. The method of claim 15, wherein the indentations are formed by punching.

20. The method of claim 14, wherein the indentation is formed before the two receptacles are caused to face each other.

21. The method of claim 14, wherein the indentation is a seat that extends across the receptacle near the end portion of the receptacle.

22. The method of claim 14, wherein the indentation does not extend entirely across the receptacle.

23. The method of claim 14, wherein the indentation is formed by punching.

24. The method of claim 14, wherein the two receptacles and the central portion are formed from a single piece of material.

25. A method of forming a setting for mounting an article, comprising:

forming a V-end prong member having two receptacles that face each other, each receptacle having a substantially V-shaped cross-section that includes two faces and a longitudinal groove joining the two faces;

forming a clearance hole in a surface of at least one of the receptacles near an end portion of at least one of the receptacles, the clearance hole extending through the at least one receptacle; and attaching at least one prong member to a central portion of the V-end prong member, the central portion connecting the two receptacles to each other, the prong member having two spaced distal ends for confining the article between the spaced distal ends and the two receptacles.

26. The method of claim 25, wherein the clearance hole forming step includes forming a clearance hole in each of the two receptacles of the V-end prong member.

27. The method of claim 26, wherein the clearance holes are formed before the two receptacles are caused to face each other.

28. The method of claim 26, further comprising forming indentations that extend across each of the receptacles, corresponding ones of the clearance holes being located in a center of the indentations.

29. The method of claim 26, wherein the clearance holes are formed by punching.

30. The method of claim 25, wherein the clearance hole is formed before the two receptacles are caused to face each other.

31. The method of claim 25, further comprising forming an indentation that extends across the at least one receptacle, the clearance hole located in a center of the indentation.

32. The method of claim 25, wherein the clearance hole is formed by punching.

33. The method of claim 25, wherein the two receptacles and the central portion are formed from a single piece of material.

* * * * *